United States Patent [19]

Schmitzer et al.

[11] Patent Number: 4,581,888

[45] Date of Patent: Apr. 15, 1986

[54] COMPRESSOR ROTATING STALL DETECTION AND WARNING SYSTEM

[75] Inventors: Charles W. Schmitzer, Stuart; James B. Kelly, Lake Worth, both of Fla.

[73] Assignee: United Technologies Corporation, Hartford, Conn.

[21] Appl. No.: 565,486

[22] Filed: Dec. 27, 1983

[51] Int. Cl.[4] ..... F02C 7/00; F02C 9/00

[52] U.S. Cl. ..... 60/39.091; 60/39.29

[58] Field of Search ..... 60/39.091, 39.27, 39.29; 415/27, 28, 118

[56] References Cited

U.S. PATENT DOCUMENTS

| | | | |
|---|---|---|---|
| 3,849,021 | 11/1974 | Eastman et al. | 60/39.29 |
| 3,867,717 | 2/1975 | Moehring et al. | 60/39.281 |
| 4,117,668 | 10/1978 | Elsaesser et al. | 60/39.29 |
| 4,164,035 | 8/1979 | Glennon et al. | 60/39.29 |

OTHER PUBLICATIONS

Sobey et al., *Control of Aircraft and Missile Power Plants*, Wiley and Sons, New York, 1963, pp. 32–33.

*Primary Examiner*—Louis J. Casaregola
*Attorney, Agent, or Firm*—Stephen E. Revis

[57] ABSTRACT

Nonrecoverable compressor rotating stall in a gas turbine engine is detected virtually at its onset by continuously calculating corrected engine speed and measuring the compressor pressure ratio. Associated with each corrected engine speed is a predetermined, empirically calculated critical pressure ratio. When the actual pressure ratio equals or falls below the critical pressure ratio a nonrecoverable stall has been detected and an output signal is generated which warns the pilot or automatically causes corrective action to be taken.

8 Claims, 3 Drawing Figures

COMPRESSOR ROTATING STALL DETECTION AND WARNING SYSTEM

The Government has rights in this invention pursuant to Contract No. F33657-79-C-0541 awarded by the Department of the Air Force.

DESCRIPTION

1. Technical Field

This invention relates to gas turbine engine compressor rotating stall detection and warning systems.

2. Background Art

Gas turbine engines experience two types of compressor stall: recoverable stall, which is known as "surge", and nonrecoverable rotating stall, which is known as "stagnation". These types of stall are well-known in the gas turbine engine art and their causes need not be discussed herein. It is sufficient to say that these stalls usually occur during transient engine operation (i.e. during acceleration and deceleration), and are most likely to occur in engines which include augmentors (i.e. afterburners), when those augmentors are brought into or are in operation. An engine experiencing a recoverable stall will, on its own, return to normal operation, although the pilot may experience a noticeable loss of power while this stall condition exits. On the other hand, a nonrecoverable rotating stall condition cannot automatically correct itself and requires the pilot to throttle back and ultimately turn off the engine before excessive damage is done to it by the ever increasing gas temperatures which accompany such a stall. The pilot must then restart the engine.

The sooner a pilot realizes that the engine is in a nonrecoverable stall condition, the better will be his chances of being able to restart the engine. Engines not equipped with a nonrecoverable rotating stall detection system require that the pilot monitor the engine speed gauge and the engine temperature gauge to decide, based upon those readings, and his judgement, whether or not he is in a nonrecoverable condition. Even if the pilot is looking at the gauges at precisely the instant that a stall (either rotating or nonrotating) occurs, there will be a delay before temperatures and engine speeds change sufficiently to make him aware of the stall condition. The pilot will also have to wait an additional length of time to ensure that the stall is not of the recoverable type before he makes the relatively drastic decision to shut off the engine. This delay further reduces his chances for successfully restarting the engine. It is, therefore, necessary that any nonrecoverable stall detection system be able to discriminate between nonrecoverable rotating and recoverable stalls in order to avoid having the pilot unnecessarily shut down and restart the engine, which is a dangerous situation, at best.

U.S. Pat. No. 3,426,322 describes a system for detecting a compressor stall, although the type of compressor stall is not discussed in the body of the patent. Basically, in that patent, whenever the exhaust gas temperature is above a predetermined value concurrently with the engine speed being between predetermined upper and lower limits, and that condition exists for a predetermined length of time (ten seconds is given as an example), then a warning signal is produced notifying aircraft personnel that the engine is in a compressor stall condition. Assuming the system is intended to warn of a nonrecoverable stall, it cannot be determined from the patent how well the system discriminates between nonrecoverable and recoverable stalls. One thing is certain, however, the system is not likely to be able to warn the pilot of a stall condition any sooner than the length of the time delay built into the system.

U.S. Pat. No. 3,867,717 teaches that the pressure ratio across the compressor decays rapidly during a nonrecoverable stall, and, therefore, it is often used as an indication of the existence of a nonrecoverable stall. As is pointed out in that patent, however, the rapid decay in compressor pressure ratio may also occur when the engine is simply decelerated; or the compressor pressure ratio may also become very low during normal flight operation at high altitude. Thus, it is taught that reliance on a decay in compressor pressure ratio alone may provide false indications of compressor stall. To preclude such false indications of compressor stall the '717 patent teaches that the turbine exhaust gas temperature must also be monitored. The initiation of a stall signal does not occur until there is a simultaneous decrease in compressor pressure ratio (below a minimum, empirically determined compressor pressure ratio) and increase in turbine exhaust temperature (above a reference exhaust temperature).

In both the '322 patent and the '717 patent discussed above, the detection and signaling of the existence of a nonrecoverable stall is dependent upon the detection of an increased exhaust gas temperature. Although pressure ratio changes occur almost instantaneously upon the onset of stall, exhaust gas temperatures change more slowly and are the limiting factor in reducing the time it takes to detect, with high reliability, the existence of a nonrecoverable stall. Several other patents which are representative of the state of the art in stall warning systems are U.S. Pat. No. 4,060,980; 4,118,926; and 4,137,710, all having the same assignee as the present application. It is desired to improve upon these systems in terms of both simplifying the system and reducing the time it takes to detect a nonrecoverable stall without the occurrence of any false detections.

DISCLOSURE OF THE INVENTION

One object of the present invention is a compressor stall warning system which is able to discriminate between recoverable and nonrecoverable compressor stalls.

A further object of the present invention is a nonrecoverable rotating compressor stall warning system which can more quickly and accurately detect the existence of a nonrecoverable stall condition than prior art systems.

According to the present invention, an output signal is produced indicating a compressor nonrecoverable rotating stall condition when the measured compressor pressure ratio at a then existing corrected engine speed equals or falls below a predetermined pressure ratio for that corrected engine speed.

It has been surprisingly determined that at each engine speed (corrected to normalize for engine inlet temperature) a critical compressor pressure ratio $P_c$ can be empirically determined wherein the actual compressor pressure ratio always falls below such predetermined pressure ratio within only a fraction of a second of the onset of a nonrecoverable rotating stall within the compressor, and wherein the actual pressure ratio rarely falls below such predetermined pressure ratio during a recoverable stall. Thus, a schedule of critical pressure ratios can be predetermined over the entire range of engine operating speeds which may be used for continuous comparison with the actual pressure ratio to determine the onset of nonrecoverable stall within a fraction of a second of its occurrence. When the actual pressure ratio equals or falls below the scheduled critical pressure ratio, an output signal indicative of stall will be generated.

In those rare cases when actual compressor pressure ratio falls below the critical pressure ratio during a recoverable stall, it will not remain below the critical pressure ratio for longer than a small fraction of a second, which is less than one-tenth second in our experience. By making sure the actual pressure ratio remains below the critical pressure ratio for a short period of time before signaling the existence of a nonrecoverable stall, false non-recoverable stall detections may be completely eliminated without significantly increasing the detection time.

It has further been determined that the schedule of critical pressure ratios may be represented as a straight line relationship with corrected compressor rotor speed (i.e. corrected engine speed). Thus, if NC represents corrected engine speed and $P_R$ represents the actual pressure ratio across the compressor, a constant ratio for $NC/P_R$ (hereinafter the "critical stall ratio") can be predetermined wherein, when such critical stall ratio equals or exceeds such predetermined constant, a nonrecoverable stall is known to have been in process for less than a fraction of a second or will occur within a fraction of a second.

The present invention is a further advance in the state of the art of stall detection over commonly owned U.S. patent application Ser. No. 390,573 "Engine Stall Early Warning System" by Judith Foster and John St. Jacques filed June 21, 1982.

Other features and advantages will be apparent from the Specification and Claims and from the accompanying drawings which illustrate an embodiment of the invention.

BEST MODE FOR CARRYING OUT THE INVENTION

Figure 1:
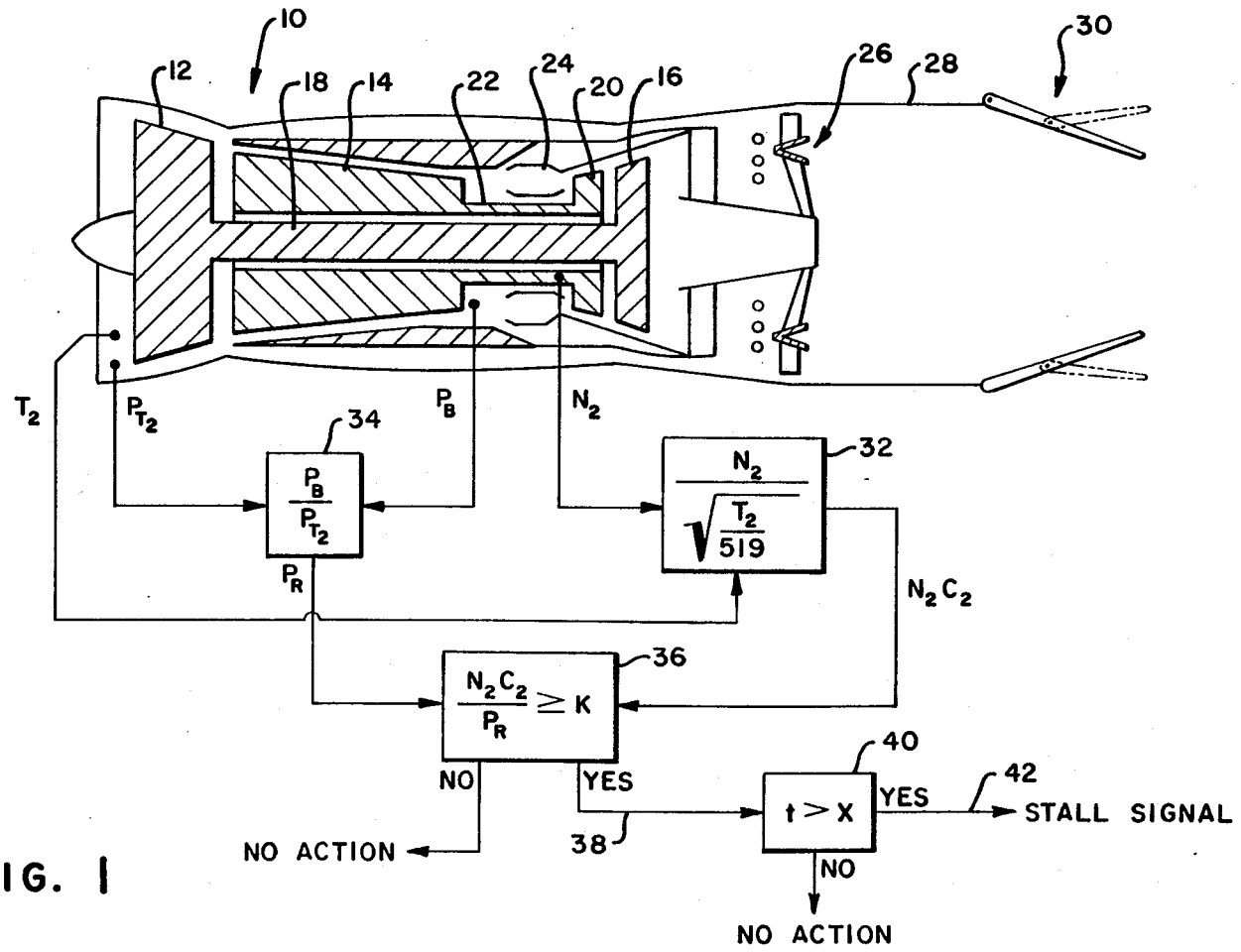
FIG. 1 is a schematic and block diagram of a ducted twin spool turbofan engine incorporating the stall detection system of the present invention.

A diagramatic representation of the stall warning system of the present invention is shown in FIG. 1, wherein a gas turbine engine is drawn schematically and is generally represented by the reference numeral 10. In this particular example, the engine 10 is a twin spool augmented turbofan engine having a low compressor 12 followed by a high compressor 14. The low compressor 12 includes the fan, and is driven by the low turbine 16 to which it is connected by a shaft 18. The high compressor 14 is driven by a high turbine 20 to which it is connected through a shaft 22. A combustor or burner 24, to which fuel is supplied, provides energy to drive the turbines 16, 20. An afterburner or augmentor 26 is disposed within an exhaust duct 28 downstream of the turbine 16. The gases which pass through the turbines are expanded through a variable area exhaust nozzle 30.

In a twin spool engine, nonrecoverable stall occurs in the high spool. Therefore, the above discussed relationship or correlation between the onset of nonrecoverable stall, compressor pressure ratio, and corrected engine speed is only valid when the corrected engine speed is the corrected high rotor speed. Similarly, the pressure ratio must at least encompass the pressure ratio across the high compressor 14, since it is within the high compressor that the pressures become abnormal during a nonrecoverable stall. In general, in the case of a twin spool engine, relationships discussed herein between the onset of nonrecoverable stall and the compressor pressure ratio are valid as long as the pressure ratio is measured from a point at or upstream of the inlet of the high compressor 14 to a point at or just downstream of the outlet to the high compressor, such as at the inlet to the burner 24. In this particular embodiment the pressure ratio used is the pressure ratio across both compressors, even though the pressure ratio across only the high spool would work equally as well.

Figure 2:
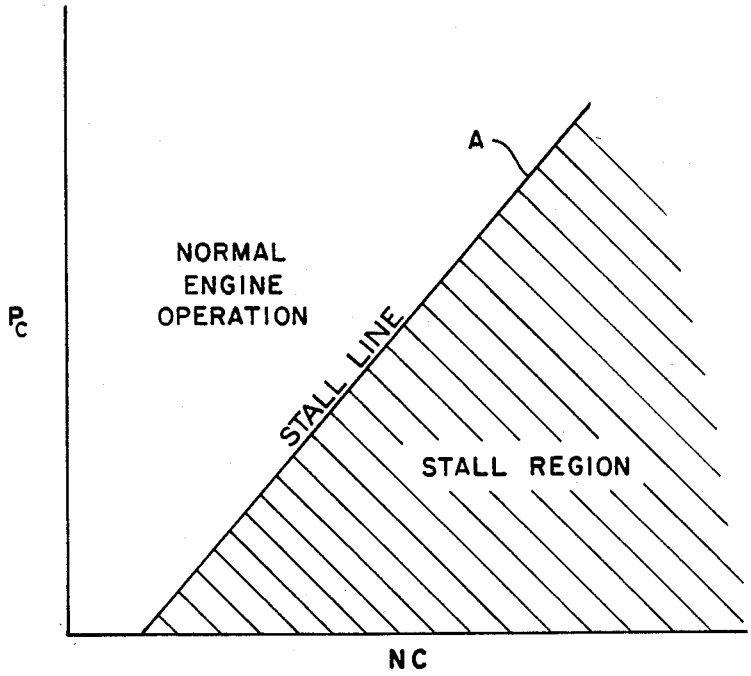
FIG. 2 is a graph which illustrates an engine parameter relationship which may be used in the present invention.

A critical pressure ratio $P_c$ may be predetermined by inducing a nonrecoverable stall in a test engine at a desired corrected engine speed NC and noting the actual pressure ratio at the stall's onset, which is the critical pressure ratio $P_c$ for that speed. It has been found that when this data is plotted on a graph of critical pressure ratio vs corrected engine speed, the data appears to fall in a straight line. Using the method of least squares, a straight line may be drawn through the data. The line "A" of FIG. 2 depicts such a straight line. The line A is hereinafter referred to as the "stall line". Above the stall line is the engine normal operating region. Below the stall line is the high compressor rotating stall region. Since the stall line is a straight line, the relationship between the compressor pressure ratio, corrected high rotor speed, and nonrecoverable stall may be represented by the following equation:

$$NC/P_R \geqq K$$

wherein K is a constant having a value equal to the slope of the stall line A. When the equation is satisfied, the engine has just gone into or is about to go into nonrecoverable stall.

Referring to FIG. 1, and in accordance with the present invention, the temperature $T_2$ of the gas stream at the fan inlet to the low compressor and the speed $N_2$ of the high compressor are measured and fed to a divider 32 which calculates the corrected high rotor speed $N_2C_2$ and produces an output signal indicative thereof. More specifically, in the divider 32, the measured high rotor speed is divided by $T_2/519$. Determining corrected rotor speed is not considered a part of the present invention and is well-known in the art.

The pressure at the inlet to the low compressor $P_{T2}$ (engine inlet pressure) and the pressure at the burner inlet, $P_B$ are measured and fed to a divider 34 which calculates the ratio $P_B/P_{T2}$ and produces an output signal $P_R$ indicative of the actual pressure ratio across both compressors.

The pressure ratio signal from the divider 34 and the corrected high rotor speed signal from the divider 32 are fed to a divider/comparator 36 which calculates the ratio: $N_2C_2/P_R$ and compares it to the predetermined stall line constant K. If the ratio is less than K, no action is taken. If the ratio is greater than or equal to K, then the engine is operating in the rotating stall region of the graph of FIG. 2, and the divider/comparator 36 generates a suitable output signal 38.

In order to eliminate even the smallest possibility that the engine is operating below the stall line due to a transient pressure drop as a result of a recoverable stall, the output signal 38 is continuously fed to a timer 40 as long as the engine is operating in the stall region. The timer 40 generates a nonrecoverable stall signal 42 if it receives the output signal 38 from the divider/comparator 36 uninterrupted for a predetermined short period of time, X, which need only be on the order of a tenth of a second or less. The stall signal 42 from the timer 38 may be used to simply signal the pilot of the existence of a nonrecoverable stall and/or it could trigger automatic corrective action, such as automatic engine shutdown and restart.

Figure 3:
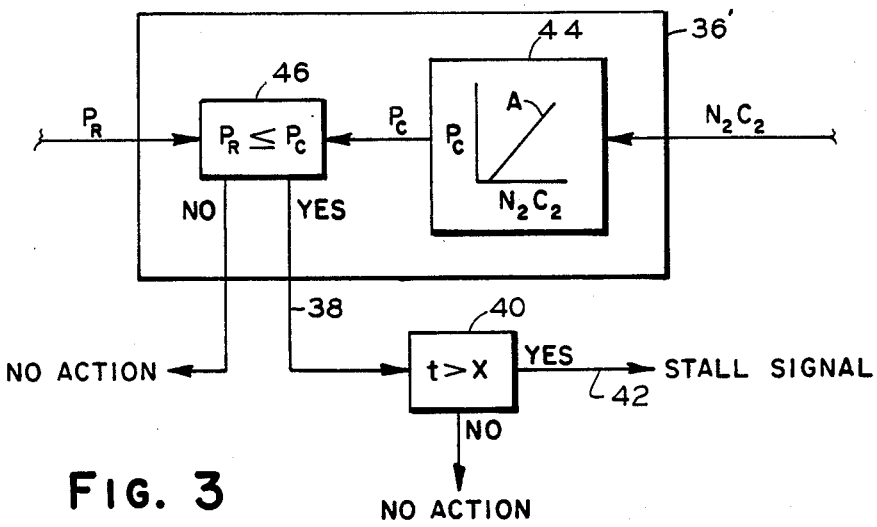
FIG. 3 is a schematic block diagram showing an alternate embodiment for one of the elements depicted in FIG. 1.

In accordance with the teachings of the present invention, the comparator/divider 36 may be replaced by the essentially equivalent apparatus 36' shown in FIG. 3. In that case, the corrected high rotor speed signal $N_2C_2$ from the divider 32 is fed to a pressure ratio generator 44 which generates a scheduled critical pressure ratio $P_c$ based upon a curve such as the curve A of FIG. 2. The critical pressure ratio $P_c$ and actual pressure ratio $P_R$ are fed to a comparator 46 which determines if $P_R$ is less than or equal to $P_c$. If it is, an output signal 38 is generated which is fed to the timer 40, and the process thereafter proceeds as shown and discussed with respect to FIG. 1.

We claim:

1. Stall detection apparatus for detecting nonrecoverable rotating stall in a gas turbine engine having a compressor, the apparatus comprising:

means for detecting the speed of the compressor and for generating a signal N indicative thereof;

means for detecting engine inlet temperature T and for generating a signal indicative thereof;

means for receiving said compressor speed signal N and said temperature signal T and for generating a signal therefrom indicative of corrected compressor speed NC;

means for detecting the actual pressure ratio $P_R$ across the compressor and generating a signal indicative thereof;

comparator means for receiving the pressure ratio signal and corrected compressor speed signal and for producing an output signal when $P_R$ is less than or equal to a predetermined value $P_c$, which is the pressure ratio at the onset of a rotating stall and which varies with corrected speed NC; and timer means for receiving the output signal from said comparator means and for generating an output signal indicative of the existence of a nonrecoverable rotating stall in the compressor if said comparator means output signal is received continuously for a predetermined period of time.

2. The stall detection apparatus according to claim 1, wherein the gas turbine engine is a twin spool engine, having a high and low compressor, said high compressor having an inlet and outlet, and said compressor speed N is the high compressor speed and said means for detecting pressure ratio includes means for measuring the pressure ratio from a point at or upstream of the high compressor inlet to a point at or just downstream of the high compressor outlet, whereby the said pressure ratio $P_R$ at least encompasses the pressure ratio across the high compressor.

3. The stall detection apparatus according to claim 1 wherein said comparator means includes a critical pressure ratio generator for receiving said corrected speed signal and for generating therefrom a signal indicative of the critical pressure ratio $P_c$.

4. The stall detection apparatus according to claim 1 wherein $P_c$ varies approximately directly with NC, and wherein said comparator means includes means for receiving said corrected speed signal and actual pressure ratio signal and for calculating the value $NC/P_R$ therefrom, and for producing an output signal when $NC/P_R$ exceeds or equals a predetermined constant value K which is the slope of a line representing the direct relationship between $P_c$ and NC.

5. A method for detecting nonrecoverable compressor rotating stall in a gas turbine engine having a compressor, comprising the steps of:

detecting compressor speed N;

detecting engine inlet temperature T;

calculating corrected compressor speed NC from N and T;

detecting a pressure ratio $P_R$ across the compressor; and producing an output signal when $P_R$ becomes and remains less than or equal to a predetermined value $P_c$ for a predetermined length of time, wherein $P_c$ is the pressure ratio at the onset of a rotating stall and varies with corrected engine speed, said output signal being indicative of the existence of nonrecoverable stall in the compressor.

6. The method according to claim 5 wherein the engine is a twin spool engine, N is the speed of the high spool, and $P_R$ is a compressor pressure ratio encompassing at least the pressure ratio across the high spool.

7. The method according to claim 5 wherein $NC/P_c$ is a constant for all corrected compressor speeds.

8. A method for detecting nonrecoverable compressor rotating stall in a gas turbine engine having a compressor, comprising the steps of:

detecting compressor speed N;

detecting engine inlet temperature T;

calculating corrected compressor speed NC from N and T and generating a predetermined critical pressure ratio value $P_c$ based thereon which represents the pressure ratio at the onset of a rotating stall;

detecting a pressure ratio $P_R$ across the compressor;

producing a stall signal when $P_R$ is equal to or less than $P_c$ continuously for a predetermined short period of time.

* * * * *

UNITED STATES PATENT AND TRADEMARK OFFICE

CERTIFICATE OF CORRECTION

PATENT NO. : 4,581,888

DATED : April 15, 1986

INVENTOR(S) : Charles W. Schmitzer et al.

It is certified that error appears in the above-identified patent and that said Letters Patent is hereby corrected as shown below:

Column 4, line 53: change "$T_2/519$" to --$\sqrt{T_2/519}$--

Signed and Sealed this

Twenty-first Day of February, 1989

*Attest:*

DONALD J. QUIGG

*Attesting Officer*

*Commissioner of Patents and Trademarks*